US009779640B2

(12) United States Patent
Ruhaak

(10) Patent No.: US 9,779,640 B2
(45) Date of Patent: Oct. 3, 2017

(54) SELF-ERECTABLE DISPLAYS AND METHODS OF MAKING SUCH SELF-ERECTABLE DISPLAYS

(71) Applicant: R.R. Donnelley & Sons Company, Chicago, IL (US)

(72) Inventor: Laura Ruhaak, Brookfield, IL (US)

(73) Assignee: R.R. DONNELLEY & SONS COMPANY, Chicago, IL (US)

( * ) Notice: Subject to any disclaimer, the term of this patent is extended or adjusted under 35 U.S.C. 154(b) by 0 days.

(21) Appl. No.: 14/709,266

(22) Filed: May 11, 2015

(65) Prior Publication Data

US 2016/0335925 A1 Nov. 17, 2016

(51) Int. Cl.

| | |
|---|---|
| ***G09F 1/06*** | (2006.01) |
| *G09F 15/00* | (2006.01) |
| *A47F 5/00* | (2006.01) |

(52) U.S. Cl.

CPC ..... *G09F 1/065* (2013.01); *A47F 5/00* (2013.01); *G09F 15/00* (2013.01)

(58) Field of Classification Search

CPC .... G09F 15/0056; G09F 15/0062; G09F 7/18; G09F 7/02; G09F 15/0075; A47F 5/00; A09F 1/06; A09F 1/065

See application file for complete search history.

(56) References Cited

U.S. PATENT DOCUMENTS

| | | | |
|---|---|---|---|
| 822,841 | A | 6/1906 | Hill |
| 956,916 | A | 5/1910 | Wiederseim, Jr. |
| 1,028,147 | A | 6/1912 | Stranders |
| 1,545,771 | A | 7/1925 | Hout |
| 1,576,672 | A | 3/1926 | Miller |
| 1,656,341 | A | 1/1928 | Smith |
| 1,670,464 | A | 5/1928 | Marsh |
| 1,687,616 | A | 10/1928 | Huye |
| 1,902,566 | A | 3/1933 | Marsh |
| 2,108,349 | A | 2/1938 | Rasmussen |

(Continued)

FOREIGN PATENT DOCUMENTS

| | | |
|---|---|---|
| CN | 203192354 | 9/2013 |
| DE | 2658506 | 1/1978 |

(Continued)

OTHER PUBLICATIONS

United States Patent and Trademark Office, "Non-Final Office Action," issued in connection with U.S. Appl. No. 14/711,739, mailed on Sep. 16, 2016, 37 pages.

(Continued)

*Primary Examiner* — Cassandra Davis

(74) *Attorney, Agent, or Firm* — Hanley, Flight & Zimmerman, LLC

(57) ABSTRACT

Self-erectable displays and methods of making such self-erectable displays are disclosed. An example apparatus includes a shroud including a first shroud panel; a second shroud panel opposite the first shroud panel; a first end separating the first shroud panel and the second shroud panel; and a second end separating the first shroud panel and the second shroud panel; and an elastic band to be coupled to the shroud between the first and second ends to outwardly bias the first shroud panel relative to the second shroud panel to enable the shroud to have an oblong cross-section when erected.

11 Claims, 9 Drawing Sheets

(56) References Cited

U.S. PATENT DOCUMENTS

| | | | |
|---|---|---|---|
| 2,113,288 | A | 4/1938 | Berger |
| 2,142,826 | A | 1/1939 | Rosello |
| 2,153,460 | A | 4/1939 | Giles |
| 2,210,317 | A | 8/1940 | Dueringer |
| 2,283,406 | A | 5/1942 | Bacon |
| 2,290,144 | A | 7/1942 | Katz |
| 2,404,089 | A | 7/1946 | Pollock |
| 2,601,374 | A | 6/1952 | Ditzler et al. |
| 2,637,924 | A | 5/1953 | Hutt |
| 2,728,461 | A | 12/1955 | Paige |
| 2,773,324 | A | 12/1956 | Drueck, Jr. |
| 2,833,074 | A | 5/1958 | Jannes |
| 2,892,276 | A | 6/1959 | Nelson |
| 2,918,178 | A | 12/1959 | Leone |
| 2,984,920 | A | 5/1961 | Acosta et al. |
| 3,015,898 | A | 1/1962 | Keeslar |
| 3,091,877 | A | 6/1963 | Luchsinger |
| 3,234,682 | A | 2/1966 | Frankl |
| 3,267,597 | A | 8/1966 | Jannes |
| 3,302,321 | A | 2/1967 | Walker |
| 3,571,958 | A | 3/1971 | Stevens et al. |
| 3,665,669 | A | 5/1972 | Huber |
| 3,666,607 | A | 5/1972 | Weissman |
| 4,234,148 | A | 11/1980 | Maddestra et al. |
| 4,610,363 | A | 9/1986 | Flum et al. |
| 4,619,426 | A | 10/1986 | Drueck, Jr. |
| 4,750,283 | A | 6/1988 | Halpern |
| 4,770,379 | A | 9/1988 | Estvold |
| 4,773,622 | A | 9/1988 | Herlin |
| 4,774,780 | A | 10/1988 | Crowell |
| 4,790,714 | A | 12/1988 | Schnapp |
| 4,854,060 | A | 8/1989 | Corbo et al. |
| 4,940,199 | A | 7/1990 | Hall |
| 4,984,848 | A | 1/1991 | Scalisi et al. |
| 4,993,846 | A | 2/1991 | Diamond et al. |
| 5,000,717 | A | 3/1991 | Pfeiffer |
| 5,193,466 | A | 3/1993 | Eder |
| 5,197,631 | A | 3/1993 | Mishima |
| 5,297,677 | A | 3/1994 | Burian et al. |
| 5,416,997 | A | 5/1995 | Dyment et al. |
| 5,454,180 | A | 10/1995 | Volpe |
| 5,467,547 | A | 11/1995 | Fortner |
| 5,632,390 | A | 5/1997 | Podergois |
| 5,752,649 | A | 5/1998 | Weder |
| 5,758,438 | A | 6/1998 | Crowell |
| 5,778,959 | A | 7/1998 | Guetschow |
| 5,787,621 | A | 8/1998 | Leksell |
| 5,809,673 | A | 9/1998 | Johnson et al. |
| 5,868,367 | A | 2/1999 | Smith |
| 5,878,945 | A | 3/1999 | Weder |
| 5,937,553 | A | 8/1999 | Maran |
| 5,966,857 | A | 10/1999 | Pettersson et al. |
| 5,983,538 | A | 11/1999 | Crowell |
| 6,311,418 | B1 | 11/2001 | Crowell |
| 6,347,772 | B1 | 2/2002 | L'Hotel |
| 6,497,601 | B1 | 12/2002 | Ward |
| 7,134,230 | B1 | 11/2006 | Boens et al. |
| 7,159,350 | B2 | 1/2007 | L'Hotel |
| 7,234,253 | B2 | 6/2007 | Ossmann |
| 7,437,842 | B2 | 10/2008 | Sgambellone |
| 7,634,865 | B2 | 12/2009 | L'Hotel |
| 7,726,054 | B2 | 6/2010 | Mestres Armengol et al. |
| 7,774,964 | B2 | 8/2010 | L'Hotel |
| 7,980,013 | B2 | 7/2011 | Hsu |
| 8,099,883 | B2 | 1/2012 | Mestres Armengol et al. |
| 8,112,925 | B2 | 2/2012 | Tzuo |
| 8,291,631 | B2 | 10/2012 | Wilder |
| 8,458,939 | B2 | 6/2013 | Arthur et al. |
| 8,590,188 | B2 | 11/2013 | Mirsch |
| 8,701,321 | B2 | 4/2014 | Da Fonseca et al. |
| 8,776,415 | B2 | 7/2014 | Kawaguchi et al. |
| 8,826,833 | B1 | 9/2014 | Fischer et al. |
| 8,863,418 | B2 | 10/2014 | Acker et al. |
| 8,875,908 | B2 | 11/2014 | L'Hotel |
| 9,173,485 | B2 | 11/2015 | Fischer et al. |
| 2004/0111930 | A1 | 6/2004 | Ossmann |
| 2008/0066353 | A1 | 3/2008 | Mills |
| 2008/0083146 | A1 | 4/2008 | Martin Presa |
| 2010/0072330 | A1 | 3/2010 | Tzuo |
| 2010/0236117 | A1 | 9/2010 | Mestres Armengol et al. |
| 2011/0088300 | A1 | 4/2011 | Martin Presa |
| 2012/0227297 | A1 | 9/2012 | Kawaguchi et al. |
| 2013/0219760 | A1 | 8/2013 | Acker et al. |
| 2014/0265777 | A1 | 9/2014 | Fischer et al. |
| 2016/0335934 | A1 | 11/2016 | Lyon |
| 2016/0335935 | A1 | 11/2016 | Lyon |
| 2017/0193866 | A1 | 7/2017 | Bonifas |

FOREIGN PATENT DOCUMENTS

| | | | | |
|---|---|---|---|---|
| DE | 4005925 | | 10/1991 | |
| DE | 4314654 | | 11/1994 | |
| DE | 9320993 | | 8/1995 | |
| DE | 202010015312 | | 1/2011 | |
| DE | 202011002980 | | 4/2011 | |
| DE | 202014106297 | | 3/2015 | |
| DK | 9500055 | | 5/1995 | |
| DK | 9500277 | | 9/1995 | |
| EP | 1741368 | | 1/2007 | |
| EP | 1830334 | | 9/2007 | |
| EP | 1926076 | | 5/2008 | |
| EP | 2290637 | | 3/2011 | |
| EP | 2400477 | | 12/2011 | |
| ES | 2212927 | | 8/2004 | |
| ES | 2255857 | | 7/2006 | |
| FR | 1254983 | | 3/1961 | |
| FR | 2210317 | | 7/1974 | |
| FR | 2232259 | | 12/1974 | |
| FR | 2233912 | | 1/1975 | |
| FR | 2571949 | | 4/1986 | |
| FR | 2574968 | | 6/1986 | |
| FR | 2650907 | | 2/1991 | |
| FR | 2680030 | | 2/1993 | |
| FR | 2691621 | | 12/1993 | |
| FR | 2730148 | | 8/1996 | |
| FR | 2735264 | | 12/1996 | |
| FR | 2745109 | | 8/1997 | |
| FR | 2760801 | | 9/1998 | |
| FR | 2760802 | | 9/1998 | |
| FR | 2760880 | | 9/1998 | |
| FR | 2770320 | | 4/1999 | |
| FR | 2911425 | | 7/2008 | |
| FR | 2925203 | A1 * | 6/2009 | ..... G09F 1/06 |
| FR | 2925204 | | 6/2009 | |
| FR | 2948222 | A1 * | 1/2011 | ..... G09F 15/00 |
| GB | 463574 | | 4/1937 | |
| GB | 740577 | | 11/1955 | |
| GB | 743378 | | 1/1956 | |
| GB | 824004 | | 11/1959 | |
| GB | 1034280 | | 6/1966 | |
| GB | 1272187 | | 4/1972 | |
| GB | 1317155 | | 5/1973 | |
| WO | 9634379 | | 10/1996 | |
| WO | 9936900 | | 7/1999 | |
| WO | 02095719 | | 11/2002 | |
| WO | 2004044867 | | 5/2004 | |
| WO | 2006040438 | | 4/2006 | |
| WO | 2006067252 | | 6/2006 | |
| WO | 2007138083 | | 12/2007 | |
| WO | 2008049176 | | 5/2008 | |
| WO | 2010019086 | | 2/2010 | |
| WO | 2010130485 | | 11/2010 | |
| WO | 2011092209 | | 8/2011 | |
| WO | 2011113123 | | 9/2011 | |
| WO | 2012061375 | | 5/2012 | |
| WO | WO 2016/057067 | A1 * | 4/2016 | ..... A47F 5/10 |

OTHER PUBLICATIONS

United States Patent and Trademark Office, "Non-Final Office Action," issued in connection with U.S. Appl. No. 14/709,285, mailed on Sep. 15, 2016, 38 pages.

(56) References Cited

OTHER PUBLICATIONS

United States Patent and Trademark Office, "Non-Final Office Action," issued in connection with U.S. Appl. No. 15/229,920, dated Dec. 1, 2016, 9 pages.
United States Patent and Trademark Office, "Office Action," issued in connection with U.S. Appl. No. 14/709,285, dated Mar. 15, 2017, 24 pages.
United States Patent and Trademark Office, "Notice of Allowance," issued in connection with U.S. Appl. No. 15/229,920, dated Mar. 22, 2017, 43 pages.
International Searching Authority, "International Search Report and Written Opinion," issued in connection with International Patent Application No. PCT/US2016/064478, dated Jan. 24, 2017, 15 pages.
United States Patent and Trademark Office, "Final Office Action," issued in connection with U.S. Appl. No. 14/711,739, dated Mar. 21, 2017, 19 pages.
United States Patent and Trademark Office, "Non-final Office Action," issued in connection with U.S. Appl. No. 14/988,616, dated Apr. 11, 2017, 36 pages.
United States Patent and Trademark Office, "Notice of Allowance," issued in connection with U.S. Appl. No. 14/709,285, dated Jul. 3, 2017, 19 pages.

* cited by examiner

SELF-ERECTABLE DISPLAYS AND METHODS OF MAKING SUCH SELF-ERECTABLE DISPLAYS

FIELD OF THE DISCLOSURE

This disclosure relates generally to displays and, more particularly, to self-erectable displays and methods of making such self-erectable displays.

BACKGROUND

Displays may be used at a point of purchase to provide advertising or other information. Some of these displays have a tubular shape and include outwardly facing indicia.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
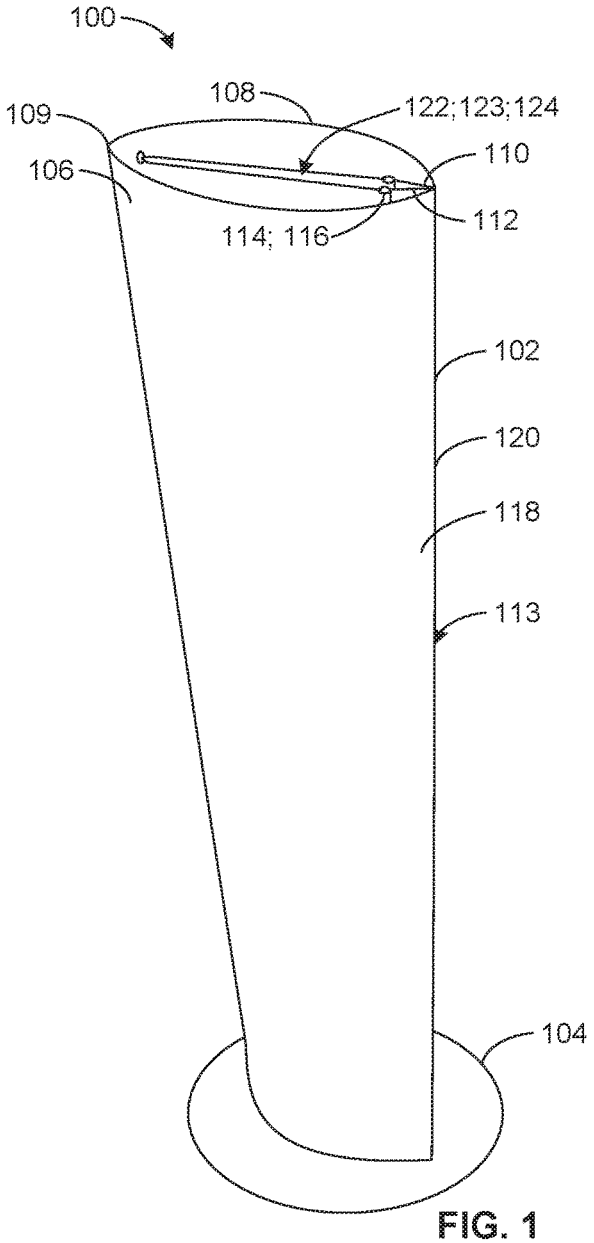
FIG. 1 is a perspective view of an example self-erectable display in accordance with the teachings of this disclosure.

The examples disclosed herein relate to self-erectable displays that can be used for point-of-sale advertising, providing information, or for other suitable purposes. In some examples, the example self-erectable displays may be shipped to a customer in a folded, flat state. The example displays may include one or more elastic band(s) that are in a state of tension when the display is in the folded, flat state because forces imparted by the folded material of the display are greater than a force exerted by the elastic band(s). However, when the display is unfolded, the force being imparted on the elastic band(s) is less than the force exerted by the elastic band(s), thereby enabling the elastic band(s) to urge the display from the folded position to the erected position. Thus, using the examples disclosed herein, an individual can erect the example displays with little if any instruction and/or training.

In some examples disclosed herein, the example self-erectable displays include an elongate, tubular shroud into which the one or more elastic band(s) are coupled. In some examples, the shroud includes an oblong cross-section having an example base coupled at an end. In some examples, the example shroud is formed of an elongate substrate having top and bottom edges and first and second side edges. To enable the example self-erectable display to be folded for shipping and/or storage, in some examples, longitudinal lines of weakness and transverse lines of weakness are defined in the shroud. The longitudinal lines of weakness may enable the example self-erectable display to be folded relatively flat and the transverse lines of weakness may enable the example self-erectable display to be folded about itself to form a c-fold or a z-fold, for example.

In some examples, the longitudinal and transverse lines of weakness define central panels and outwardly facing flaps. To form the tubular-shaped shroud, the shroud is folded about a central line of weakness and the flaps are inwardly folded and coupled to enable the shroud to have an oblong cross-section and/or to define an aperture. In some examples, the cross-section may be another shape including, for example, triangular, square, diamond, circular, or other semi-circular, elliptical, polygonal and/or non-polygonal shape(s). In some examples, to enable the shroud to be more easily folded about itself, notches are defined between the flaps.

In some examples, to enable the elastic bands to be coupled to the shroud, brackets or side rings defining a bracket aperture are disposed through first apertures defined by the shroud. In some examples, the first apertures are defined along a central line of weakness of the shroud and flap apertures are defined by the flaps. In some examples, the first apertures and the flap apertures are defined along transverse axes of the shroud. In some examples, an elastic band including barbed ends is threaded through the bracket aperture and then coupled relative to the flap apertures.

To form the self-erectable display, the flaps of the shroud are brought together and coupled. When the elastic bands are coupled within the shroud and the shroud flaps are coupled, the elastic bands outwardly bias the shroud panels to enable the shroud to have an oblong cross-section. However, if the shroud panels are moved toward one another against the biasing force of the elastic bands, the self-erectable display can be positioned in a folded state in which the shroud panels are disposed immediately adjacent one another. When the shroud panels are disposed adjacent one another, the shroud may be folded about itself along the transverse lines of weakness to enable the display to be stored and/or shipped. Thus, the examples disclosed herein enable a display to be folded flat for storage and to later self-erect into a tubular shape.

FIG. 1 illustrates an example self-erectable display 100 including a tubular-shaped shroud 102 coupled to a base 104. In other examples, the example self-erectable display 100 may not include the base 104 such that the shroud 102 is used as an upright display without the base 104.

In this example, the shroud 102 includes a first shroud panel 106 and an opposing second shroud panel 108 that are separated by a central line of weakness 109. The shroud 102 also includes a first flap 110, a second flap 112, a first side edge 114, and a second side edge 116 adjacent to the first side edge 114. In this example, the first flap 110 and the second flap 112 are coupled together to enclose the shroud 102 and to enable a first longitudinal line of weakness 118 and an adjacent second longitudinal line of weakness 120 to define an outward facing end 113 of the tubular-shaped shroud 102 opposite the central line of weakness 109 that defines another outward facing end of the shroud 102. To enable the display 100 to be self-erecting, an example first elastic band 122, a second elastic band 123, and a third elastic band 124 (see also FIGS. 2 and 6) are disposed within and extend between the central line of weakness 109 and the first flap 110 and the second flap 112.

Figure 2:
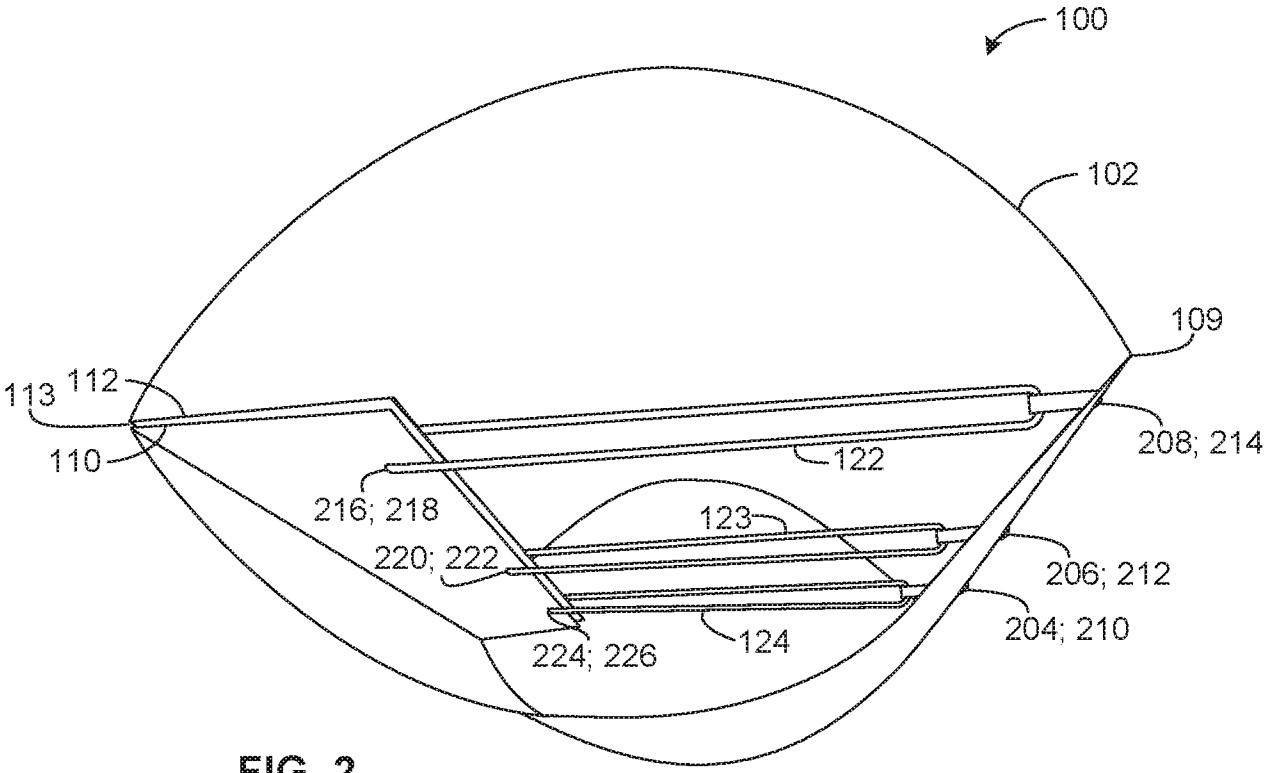
FIG. 2 is a top view of the self-erectable display of FIG. 1.

FIG. 2 shows a top view of the example self-erectable display 100 that illustrates the elastic bands 122, 123, 124 coupled within the shroud 102. In this example, the elastic bands 122, 123, 124 are the same or substantially the same size and/or shape. In addition, the example shroud 102 includes a first aperture 204 into which a first bracket 210 is disposed. The first elastic band 122 is coupled to the first bracket 210 adjacent the central line of weakness 109. Similarly, the example shroud 102 includes a second aperture 206 into which a second bracket 212 is disposed. The second elastic band 123 is coupled to the second bracket 212 adjacent the central line of weakness 109. In addition, the example shroud 102 includes a third aperture 208 into which a third bracket 214 is disposed. The third elastic band 124 is coupled to the third bracket 214 adjacent the central line of weakness 109. Though three elastic bands, apertures, and brackets are shown in the illustrated example, in other examples, other numbers may be used such as, for example, one, two, four, etc.

Figure 4:
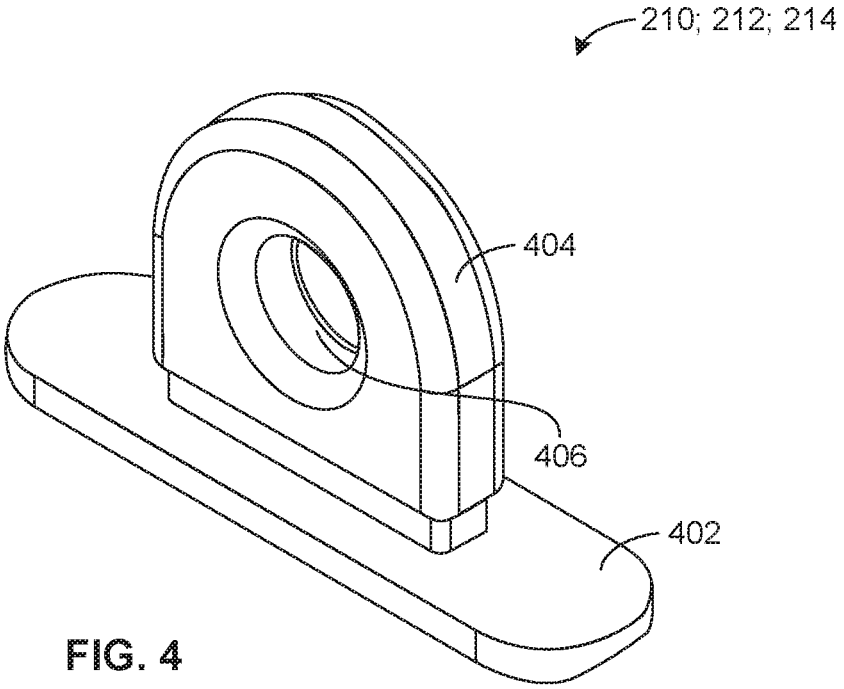
FIG. 4 illustrates an example bracket that can be used to implement the example self-erectable display of FIG. 1.

In the illustrated example of FIG. 2 and more clearly shown in FIG. 4, the brackets 210, 212, 214 include a base 402 and a protrusion 404 extending from the base 402. The base 402 may be configured to engage the shroud 102 immediately adjacent the apertures 204, 206, 208 to secure the bracket 210, 212, 214 relative to the shroud 102. In this example, the protrusion 404 defines a bracket aperture 406 through which the elastic band 122, 123, 124 is threaded.

In this example, the elastic bands 122, 123, 124 are also coupled adjacent the outward facing end 113. The first flap 110 includes a first flap aperture 216, and the second flap 112 includes a second flap aperture 218. The first flap aperture 216 and the second flap aperture 218 align when the shroud 102 is assembled, and the first elastic band 122 is coupled to the first flap aperture 216 and the second flap aperture 218. Similarly, the first flap 110 includes a third flap aperture 220, and the second flap 112 includes a fourth flap aperture 222. The third flap aperture 220 and the fourth flap aperture 222 align when the shroud 102 is assembled, and the second elastic band 123 is coupled to the third flap aperture 220 and the fourth flap aperture 222. In addition, the first flap 110 includes a fifth flap aperture 224, and the second flap 112 includes a sixth flap aperture 226. The fifth flap aperture 224 and the sixth flap aperture 226 align when the shroud 102 is assembled, and the third elastic band 124 is coupled to the fifth flap aperture 224 and the sixth flap aperture 226.

Figure 5:
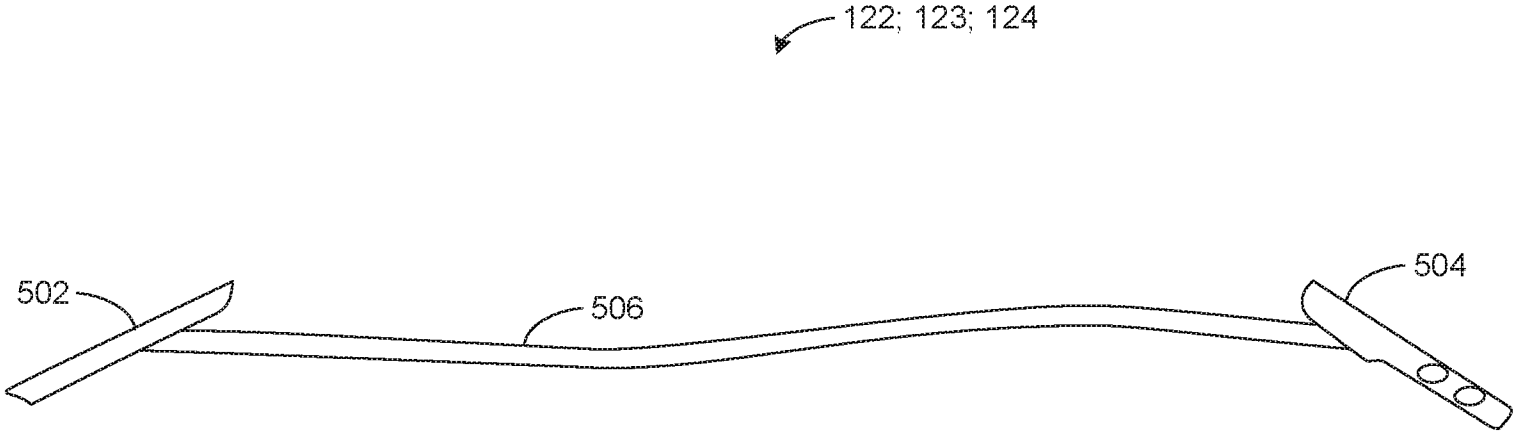
FIG. 5 illustrates an example elastic band that can be used to implement the example self-erectable display of FIG. 1.

In some examples as shown in FIG. 5, the ends of the elastic bands 122, 123, 124 include barbs (e.g., metal barbs) 502, 504 between which elastic material 506 is coupled. The barbs 502, 504 have a length greater than the diameter of the flap apertures 216, 218, 220, 222, 224, 226. Therefore, when the barbs 502, 504 are feed through the flap apertures 216, 218, 220, 222, 224, 226 and rotated, the barbs 502, 504 are prevented from slipping back through the flap apertures 216, 218, 220, 222, 224, 226 and hold the elastic bands 122, 123, 124 in their respective positions.

After the elastic bands 122, 123, 124 are coupled to the shroud 102, the flaps 110, 112 are brought together and coupled. The flaps 110, 112 may be coupled in any suitable way such as with adhesive, glue, tape, staples, and/or any other suitable mechanical and/or chemical fastener(s). For example, one example mechanical fastening including extending the elastic bands 122, 123, 124 through aperture(s) of the flaps 110, 112, etc. to couple the flaps 110, 112 together. In some such examples, barbs of the elastic bands 122, 123, 124 may be disposed through the apertures 216, 218, 220, 222, 224, 226 of the flaps 110, 112 (e.g., in opposite directions such that one bard enters the apertures through one side of the flaps and the other bard through the other side) and retained immediately adjacent the apertures 216, 218, 220, 222, 224, 226 such that the elastic bands 122, 123, 124 are disposed through and retained relative to aligned apertures 216, 218, 220, 222, 224, 226 of the flaps 110, 112. Thus, the elastic bands 122, 123, 124 couple the flaps 110, 112 together and no additional adhesive may be used. In other such examples, one barb of the elastic bands 122, 123, 124 may be disposed through each of the apertures 216, 218, 220, 222, 224, 226 and retained immediately adjacent the apertures 216, 218, 220, 222, 224, 226 of the flaps 110, 112 and the other of the barbs may be disposed through and retained relative to an aperture of the brackets 210, 212, 214 opposite the flaps 110, 112. In some such examples, the elastic bands 122, 123, 124 are shorter (e.g., ½ the length) because the barbs of the elastic bands 122, 123, 124 are not immediately adjacent one another (e.g., the elastic bands 122, 123, 124 run from the bracket to the flap apertures once). Also in some examples, to substantially ensure a tighter coupling between the flaps 110, 112, the apertures 216, 218, 220, 222, 224, 226 of the flaps 110, 112 may be defined closer to the lines of weakness 118, 120 than to the outer edge of the flaps 110, 112.

As shown in the example of FIG. 2, the biasing force imposed by the elastic bands 122, 123, 124 pulls the central line of weakness 109 and the outward facing end 113 toward each other, which outwardly urges the shroud panels 106, 108 in the direction orthogonal to longitudinal axes of the elastic bands 122, 123, 124 and facilitates the oblong cross-sectional shape of the shroud 102 when erected. To flatten the example self-erectable display 100, the shroud panels 106, 108 are urged toward one another against the biasing force of the elastic bands 122, 123, 124. For example, a user may push the shroud panels 106, 108 together to flatten the display 100.

Figure 3:
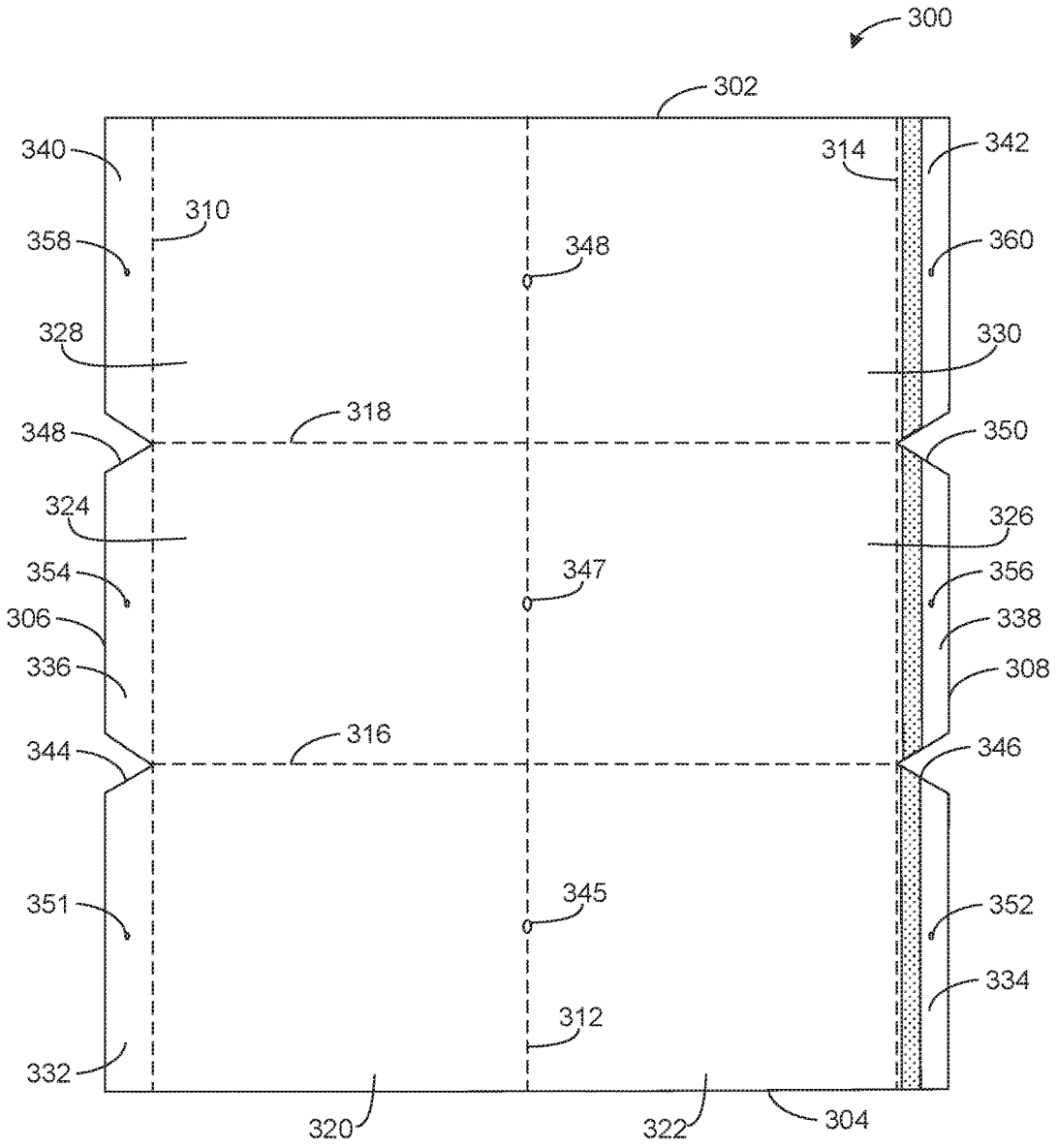
FIG. 3 illustrates a plan view of an example shroud in a flat state that can be used to implement the example self-erectable display of FIG. 1

FIG. 3 illustrates an example shroud 300 in a flat state that can be used to implement the example self-erectable display 100 of FIG. 1. While the example shroud 300 is shown as being a single piece of substrate, in other examples, the shroud may be more than one piece of substrate that are coupled together to form the example self-erectable display as disclosed herein. In this example, the shroud 300 includes a top edge 302, a bottom edge 304, a first side edge 306, and a second side edge 308. To enable the shroud 300 to be foldable for shipping and/or storage, the shroud 300 includes a first longitudinal line of weakness 310, a second longitudinal line of weakness 312, a third longitudinal line of weakness 314, a first transverse line of weakness 316, and a second transverse line of weakness 318. In some examples and as shown in FIG. 3, each of the transverse lines of weakness 316, 318 include multiple substantially parallel lines of weakness. As used herein, substantially parallel means between about zero to about 5-degrees from parallel and/or accounts for manufacturing tolerances. In this example, the longitudinal lines of weakness 310, 312, 314 are substantially perpendicular relative to the transverse lines of weakness 316, 318. As used herein, substantially perpendicular means between about zero to about 5-degrees from perpendicular and/or accounts for manufacturing tolerances.

In this example, the first longitudinal line of weakness 310, the second longitudinal line of weakness 312, the first transverse line of weakness 316, and the bottom edge 304 define a first central panel 320. The second longitudinal line of weakness 312, the third longitudinal line of weakness 314, the first transverse line of weakness 316, and the bottom edge 304 define a second central panel 322. The first longitudinal line of weakness 310, the second longitudinal line of weakness 312, the first transverse line of weakness 316, and the second transverse line of weakness 318 define a third central panel 324. The second longitudinal line of weakness 312, the third longitudinal line of weakness 314, the first transverse line of weakness 316, and the second transverse line of weakness 318 define a fourth central panel 326. The first longitudinal line of weakness 310, the second longitudinal line of weakness 312, the second transverse line of weakness 318, and the top edge 302 define a fifth central panel 328. The second longitudinal line of weakness 312, the third longitudinal line of weakness 314, the second transverse line of weakness 318, and the top edge 302 define a sixth central panel 330. The first side edge 306, the first longitudinal line of weakness 310, and the bottom edge 304 define a first flap 332 adjacent the first central panel 320. The second side edge 308, the third longitudinal line of weakness 314, and the bottom edge 304 define a second flap 334 adjacent the second central panel 322. The first side edge 306 and the first longitudinal line of weakness 310 define a third flap 336 adjacent the third central panel 324. The second side edge 308 and the third longitudinal line of weakness 314 define a fourth flap 338 adjacent the fourth central panel 326. The first side edge 306, the first longitudinal line of weakness 310, and the top edge 302 define a fifth flap 340 adjacent the fifth central panel 328. The second side edge 308, the third longitudinal line of weakness 314, and the top edge 302 define a sixth flap 342 adjacent the sixth central panel 330.

As shown in the example of FIG. 3, the shroud 300 includes a first notch 344 defined between the first flap 332 and the third flap 336, a second notch 346 defined between the second flap 334 and the fourth flap 338, a third notch 348 defined between the third flap 336 and the fifth flap 340, and a fourth notch 350 defined between the fourth flap 338 and the sixth flap 342. The example shroud 300 also includes several apertures through which the elastic bands 122, 123, 124 are to be coupled. Specifically, the shroud 300 includes a first aperture 345, a second aperture 347, and a third aperture 348 are defined along the second longitudinal line of weakness 312. The example shroud 300 also includes a first flap aperture 351 formed in the first flap 332, a second flap aperture 352 formed in the second flap 334, a third flap aperture 354 formed in the third flap 336, a fourth flap aperture 356 formed in the fourth flap 338, a fifth flap aperture 358 formed in the fifth flap 340, and a sixth flap aperture 360 formed in the sixth flap 342. In this example, the first aperture 345, the first flap aperture 351, and the second flap aperture 352 are disposed and aligned along a first transverse axis of the shroud 300. The second aperture 347, the third flap aperture 354, and the fourth flap aperture 356 are disposed and aligned along a second transverse axis of the shroud 300. In addition, the third aperture 348, the fifth flap aperture 358, and the sixth flap aperture 360 are disposed and aligned along a third transverse axis of the shroud 300.

To form and outwardly bias the tubular-shaped shroud 300, the first elastic band 122 is coupled to the third aperture 348, the fifth flap aperture 358, and the sixth flap aperture 360; the second elastic band 123 is coupled to the second aperture 347, the third flap aperture 354, and the fourth flap aperture 356; and the third elastic band 124 is coupled to the first aperture 345, the first flap aperture 351 and the second flap aperture 352. The shroud 300 is then folded about the second line of weakness 312 and the flaps 332, 334, 336, 338, 340, 342 are inwardly folded about the first and third lines of weakness 310, 314 to enable the opposing flap pairs (the first flap 332 and the second flap 334, the third flap 336 and the fourth flap 338, and the fifth flap 340 and the sixth flap 342) to be coupled to one another and disposed within an interior of the shroud 300. The opposing flap pairs (the first flap 332 and the second flap 334, the third flap 336 and the fourth flap 338, and the fifth flap 340 and the sixth flap 342) may be coupled in any suitable way using, for example, adhesive, glue, tape, staples, and/or any suitable mechanical and/or chemical fastener(s). After the opposing flap pairs (the first flap 332 and the second flap 334, the third flap 336 and the fourth flap 338, and the fifth flap 340 and the sixth flap 342 are coupled, the shroud 300 may be folded (e.g., a z-fold or a c-fold) about the first and second transverse axes 316, 318 for shipping and/or storage. In some examples, the notches 344, 346, 348, 350 may more easily enable the shroud 300 to be folded about the first and second transverse axes 316, 318.

FIG. 4 illustrates the example bracket 210, 212, 214 that can be used to implement the examples disclosed herein. In some examples, the bracket 210, 212, 214 is made of plastic, metal or any other suitable material or combination of suitable material(s). Also, in some examples, other desired shapes may be used as the bracket to hold one or more biasing members such as, for example, the elastic bands 122, 123, 124. In addition, in some examples, the brackets 210, 212, 214 are coupled to the shroud 102 via a mechanical and/or chemical fastener. For example, the brackets 210, 212, 214 may be glued or otherwise adhered to the shroud 102. In other examples, the brackets 210, 212, 214 may be slipped or woven through a slit in the shroud 102 such as, for example, the apertures 345, 347, 348.

FIG. 5 illustrates the example elastic band 122, 123, 124 that can be used to implement the examples disclosed herein. In some examples, the barbs 502, 504 are threaded through the flap apertures 350, 352, 354, 356, 358, 360 to enable the barbs 502, 504 to engage the flaps 332, 334, 336, 338, 340, 342 and couple the elastic band 122, 123, 124 to the self-erectable display 100. Also, in some examples, other suitable biasing members may be used alternatively or in additional to the example elastic band 122, 123, 124 shown in FIG. 5.

Figure 6:
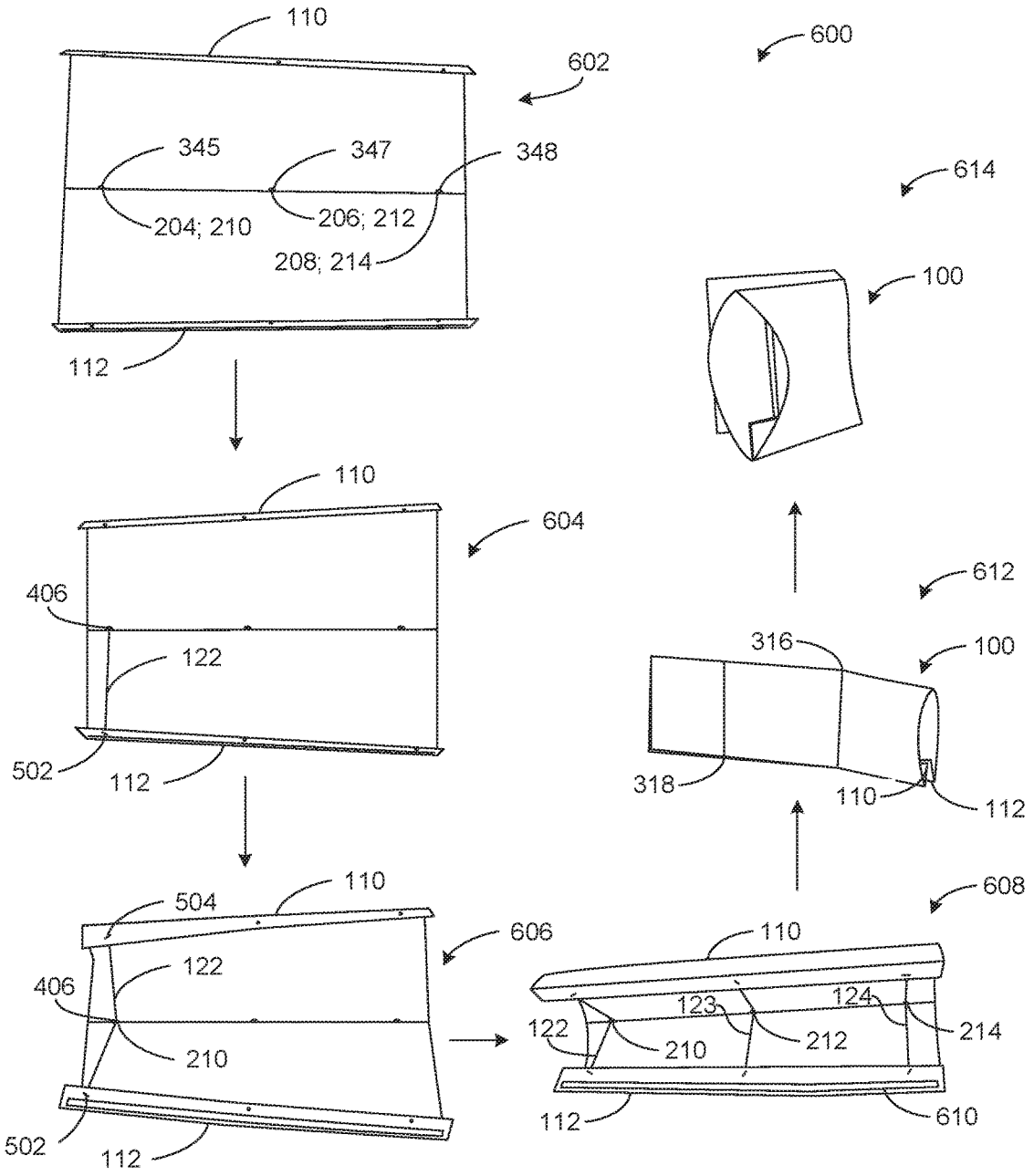
FIG. 6 illustrates an example flow diagram including processes of forming the example self-erectable display of FIG. 1.

FIG. 6 is an example flow diagram 600 that illustrates example processes of assembling the example self-erectable display 100. Reference number 602 illustrates an example shroud 600 in a flat or non-tubular state including the brackets 210, 212, 214 extending through the apertures 345, 347, 348. The example shroud 600 is substantially similar to the example shroud 300. However, in contrast to the example shroud 300, the example shroud 600 does not include the notches 344, 346, 348, 350. At reference number 604, the barb 502 of the elastic band 122 is coupled to the second flap 112, and the elastic band 122 is threaded through the bracket aperture 406. At reference 606, the barb 504 of the elastic band 122 is coupled to the first flap 110. Reference number 608 shows the elastic bands 122, 123, 124 coupled to the shroud 600 and a fastener (e.g., double sided tape) 610 on the second flap 112. Reference number 612 shows the flaps 110, 112 being coupled via the fastener 610 to enable the elastic bands 122, 123, 124 to outwardly bias the self-erectable display. At reference 614, the self-erectable display 100 is folded about the lines of weakness 316, 318 for storage and/or shipping.

Figure 7:
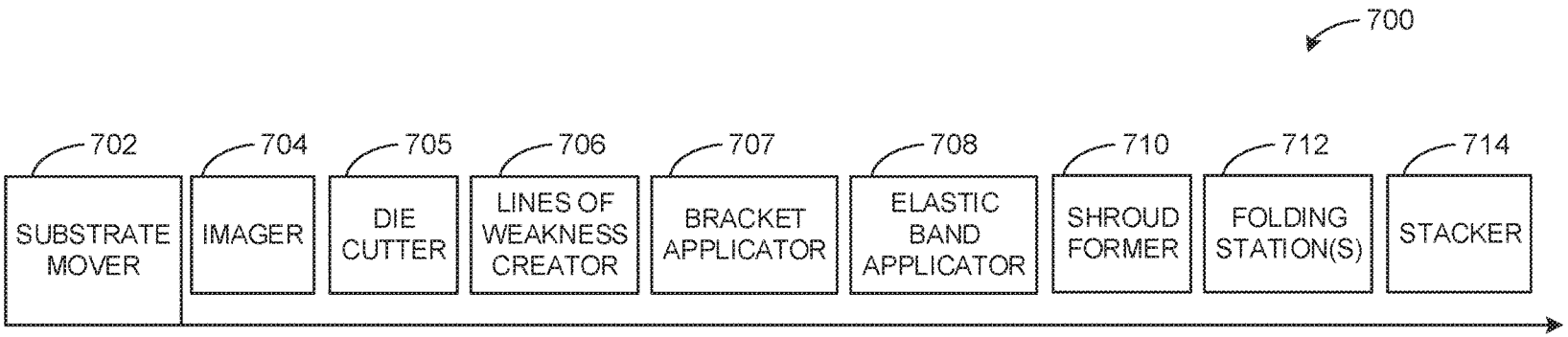
FIG. 7 illustrates an example apparatus that can be used to produce the example self-erectable displays disclosed herein.

FIG. 7 represents an example apparatus 700 that can be used to produce the example self-erectable displays disclosed herein. In some examples, the apparatus 700 performs an in-line process that includes processes to produce an example shroud in accordance with the teachings of this disclosure and processes to produce an example self-erectable display in accordance with the teachings of this disclosure. While the processes disclosed below are described in connection with automatic processes, any and/or all of the processes disclosed may instead be implemented manually.

In this example, the example apparatus 700 includes elements to produce the example shroud and/or the example self-erectable display including, for example, a substrate mover 702, an imager 704, a die cutter 705, a lines of weakness creator 706, a bracket applicator 707, an elastic band applicator 708, a shroud former 710, a folding station 712 and a stacker 714.

To produce an example shroud in accordance with the teachings of this disclosure, in some examples, the substrate mover 702 feeds one or more pieces of substrate and/or a web of substrate into the apparatus 700. In some examples, the imager 704 images a first and/or a second side of the shroud blank. The images may include brand-related images and/or text, advertising-related images and/or text, point-of-purchase-related images and/or text, instructional images and/or text, and/or any other desired indicia. The die cutter 705 forms one or more apertures and/or notches within the shroud. The lines of weakness creator 706 forms one or more lines of weakness on first and/or second sides of the shroud blank using a die(s), a cutting tool(s), a scoring tool(s), a slotting tool(s), etc. The bracket applicator 707 inserts one or more bracket(s) through one or more of the aperture(s) defined by the die cutter 705. In some examples, the bracket applicator 707 inserts one or more bracket(s) through the apertures defined along a central line of weakness of the shroud.

The elastic band applicator 708 couples one or more elastic band(s) adjacent one or more flap apertures defined by the shroud and through bracket aperture(s) defined by the corresponding bracket(s). In some examples, the elastic bands includes barbs to facilitate coupling the elastic bands to the flap apertures and retention therein. In some examples, the shroud former 710 forms a tubular-shaped shroud by folding the shroud about a central line of weakness and coupling inwardly facing flaps. The folding station 712 flattens and/or folds the self-erectable display about longitudinal axes of the shroud and/or folds the self-erectable display about transverse axes of the shroud for storage and/or shipping. The stacker 714 stacks the self-erectable displays for storage and/or shipping, etc. In some examples, the processes implemented by the bracket applicator 707, the elastic band applicator 708, the shroud former 710, the folding station 712 and/or the stacker 714 are performed manually.

While the stations and/or portions including the example substrate mover 702, the example imager 704, the example die cutter 705, the example lines of weakness creator 706, the example bracket applicator 707, the example elastic band applicator 708, the example shroud former 710, the example folding station 712 and/or the example stacker 714 of the apparatus 700 are depicted in a particular order, the stations and/or portions including the example substrate mover 702, the example imager 704, the example die cutter 705, the example lines of weakness creator 706, the example bracket applicator 707, the example elastic band applicator 708, the example shroud former 710, the example folding station 712 and/or the example stacker 714 may be implemented in any other way. For example, the order of the stations and/or portions including the example substrate mover 702, the example imager 704, the example die cutter 705, the example lines of weakness creator 706, the example bracket applicator 707, the example elastic band applicator 708, the example shroud former 710, the example folding station 712, the example stacker 714 may be changed, and/or some of the stations and/or portions including the example substrate mover 702, the example imager 704, the example die cutter 705, the example lines of weakness creator 706, the example bracket applicator 707, the example elastic band applicator 708, the example shroud former 710, the example folding station 712 and/or the example stacker 714 may be changed, eliminated, or combined. For example, while the apparatus 700 is depicted as having a die cutter being separate from a lines of weakness creator, in some examples, the die cutter and the lines of weakness creator may be combined.

Figure 8:
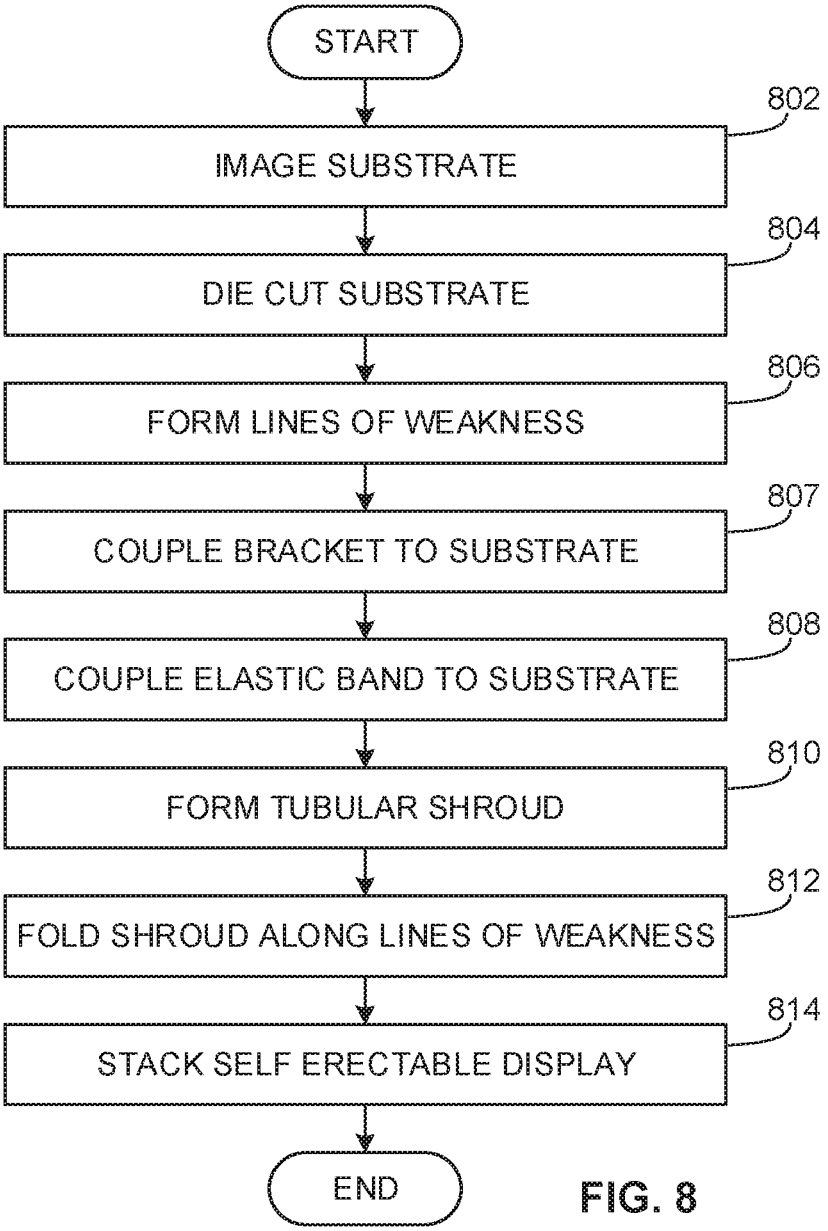
FIG. 8 illustrates a flowchart representative of machine readable instructions that may be executed to implement the apparatus of FIG. 7.

A flowchart representative of example machine readable instructions for implementing the apparatus 700 of FIG. 7 is shown in FIG. 8. In this example, the machine readable instructions comprise a program for execution by a processor such as the processor 912 shown in the example processor platform 900 discussed below in connection with FIG. 9. The program may be embodied in software stored on a tangible computer readable storage medium such as a CD-ROM, a floppy disk, a hard drive, a digital versatile disk (DVD), a Blu-ray disk, or a memory associated with the processor 912, but the entire program and/or parts thereof could alternatively be executed by a device other than the processor 912 and/or embodied in firmware or dedicated hardware. Further, although the example program is described with reference to the flowchart illustrated in FIG. 8, many other methods of implementing the example apparatus 700 may alternatively be used. For example, the order of execution of the blocks may be changed, and/or some of the blocks described may be changed, eliminated, or combined.

As mentioned above, the example processes of FIG. 8 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and transmission media. As used herein, "tangible computer readable storage medium" and "tangible machine readable storage medium" are used interchangeably. Additionally or alternatively, the example processes of FIG. 8 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and transmission media. As used herein, when the phrase "at least" is used as the transition term in a preamble of a claim, it is open-ended in the same manner as the term "comprising" is open ended.

The process of FIG. 8 includes imaging a substrate (e.g., the shroud 300) (block 802) using, for example, the imager 704 that images a first and/or second side of the shroud with, for example, brand-related images and/or text, advertising-related images and/or text, point-of-purchase-related images and/or text, instructional images and/or other text, indicia and/or images.

Apertures and/or flaps are formed on the first substrate (e.g., the support 300) (block 804) using, for example, the die cutter 705 that die cuts the shroud to form the apertures and/or the flaps. The die cutter 705 may also be used to form notches (e.g., the notches 344, 346, 348, 350). Lines of weakness are formed on the shroud blank (block 806) using, for example, the lines of weakness creator 706 that forms one or more lines of weakness on first and/or second sides of the shroud blank using a die(s), a cutting tool(s), a scoring tool(s), a slotting tool(s), etc. Brackets are disposed through some of the apertures defined by the shroud (block 807) using, for example, the bracket applicator 707 that positions brackets through apertures defined along a central line of weakness of the shroud. An elastic band(s) is coupled to the shroud (block 808) using, for example, the elastic band applicator 708 that couples ends of the elastic bands to the flaps and threads the elastic bands through the bracket apertures such that the elastic bands extend along transverse axes of the display when the display is in the flat state.

The tubular shroud is formed (block 810) using, for example, the shroud former 710 that folds the shroud about a central line of weakness and couples inwardly facing flaps using, for example, adhesive, glue and/or a staple(s). The self-erectable display is folded along lines of weakness (block 812) using, for example, the folding station 712 that flattens and/or folds the self-erectable display about longitudinal axes of the shroud and/or transverse axes of the shroud for storage and/or shipping. The folded self-erectable display is stacked (block 814) using, for example, the stacker 714 that stacks the self-erectable displays for storage and/or shipping, etc.

Figure 9:
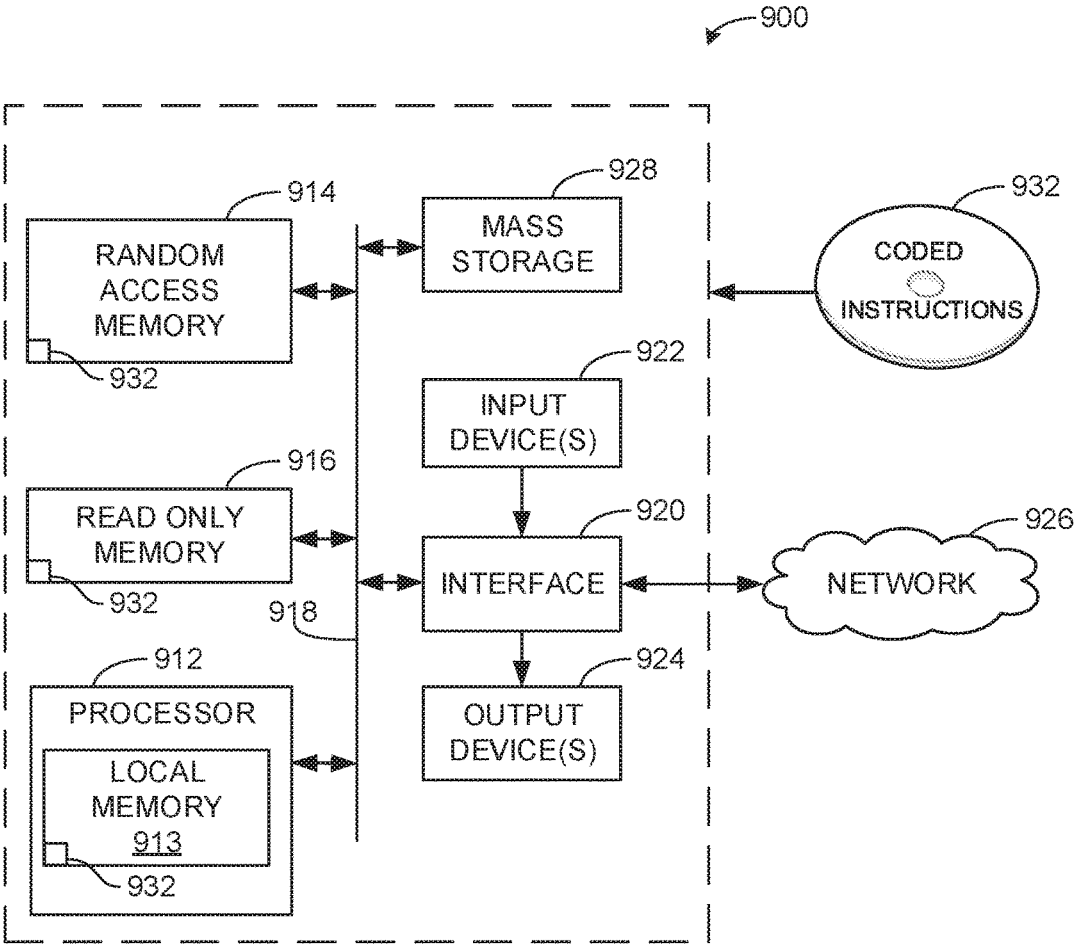
FIG. 9 illustrates a processor platform to execute the instructions of FIG. 8 to implement the apparatus of FIG. 7.

FIG. 9 is a block diagram of an example processor platform 900 capable of executing the instructions of FIG. 8 to implement the apparatus 700 of FIG. 7. The processor platform 800 can be, for example, a server, a personal computer, a mobile device (e.g., a tablet such as an iPad™), an Internet appliance, a DVD player, a CD player, a digital video recorder, a Blu-ray player, or any other type of computing device.

The processor platform 900 of the illustrated example includes a processor 912. The processor 912 of the illustrated example is hardware. For example, the processor 912 can be implemented by one or more integrated circuits, logic circuits, microprocessors or controllers from any desired family or manufacturer.

The processor 912 of the illustrated example includes a local memory 913 (e.g., a cache). The processor 912 of the illustrated example is in communication with a main memory including a volatile memory 914 and a non-volatile memory 916 via a bus 918. The volatile memory 914 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 916 may be implemented by flash memory and/or any other desired type of memory device. Access to the main memory 914, 916 is controlled by a memory controller.

The processor platform 900 of the illustrated example also includes an interface circuit 920. The interface circuit 920 may be implemented by any type of interface standard, such as an Ethernet interface, a universal serial bus (USB), and/or a PCI express interface.

In the illustrated example, one or more input devices 922 are connected to the interface circuit 920. The input device(s) 922 permit(s) a user to enter data and commands into the processor 912. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 924 are also connected to the interface circuit 920 of the illustrated example. The output devices 924 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 920 of the illustrated example, thus, typically includes a graphics driver card, a graphics driver chip or a graphics driver processor.

The interface circuit 920 of the illustrated example also includes a communication device such as a transmitter, a receiver, a transceiver, a modem and/or network interface card to facilitate exchange of data with external machines (e.g., computing devices of any kind) via a network 926 (e.g., an Ethernet connection, a digital subscriber line (DSL), a telephone line, coaxial cable, a cellular telephone system, etc.).

The processor platform 900 of the illustrated example also includes one or more mass storage devices 928 for storing software and/or data. Examples of such mass storage devices 928 include floppy disk drives, hard drive disks, compact disk drives, Blu-ray disk drives, RAID systems, and digital versatile disk (DVD) drives.

The coded instructions 932 of FIG. 8 may be stored in the mass storage device 928, in the volatile memory 914, in the non-volatile memory 916, and/or on a removable tangible computer readable storage medium such as a CD or DVD.

As set forth herein, an example apparatus includes a shroud including: a first shroud panel; a second shroud panel opposite the first shroud panel; a first end separating the first shroud panel and the second shroud panel; and a second end separating the first shroud panel and the second shroud panel; and an elastic band to be coupled to the shroud between the first and second ends to outwardly bias the first shroud panel relative to the second shroud panel to enable the shroud to have an oblong cross-section when erected.

In some examples, the apparatus includes a first shroud line of weakness between the first and second shroud panels at the first end. In some examples, the apparatus includes a first aperture defined along the first shroud line of weakness. In some examples, the apparatus includes a bracket disposed within the first aperture, the elastic band coupled to the bracket. In some examples, the shroud further includes a first side edge and a second side edge, the first side edge coupled to the second side edge at the second end. In some examples, the apparatus includes a second shroud line of weakness between the first and second shroud panels at the second end. In some examples, the shroud is collapsible by urging the first shroud panel toward the second shroud panel against a biasing force of the elastic band to increase the distance between the first shroud line of weakness and the second shroud line of weakness.

In some examples, the shroud further includes a first flap and a second flap coupled to the first flap. In some examples, the apparatus includes a first aperture formed in the first flap; and a second aperture formed in the second flap, the first aperture to align with the second aperture, and the elastic band coupled to the first aperture and the second aperture. In some examples, the elastic band includes a barb having a length greater than a first diameter of the first aperture and a second diameter of the second aperture. In some examples, the first shroud panel includes a first transverse line of weakness and the second shroud panel includes a second transverse line of weakness, the first and second transverse lines of weakness to be immediately adjacent one another when the shroud is collapsed. In some examples, the shroud is foldable about the first and second transverse lines of weakness. In some examples, the apparatus is a self-erecting display.

An example apparatus includes a shroud including a first shroud panel, a second shroud panel coupled to the first shroud panel at a first end and a second end, an interior formed between the first shroud panel and the second shroud panel; and a biasing member coupled to the shroud between the first and second ends, the biasing member to cause a portion of the first shroud panel to separate from a portion of the second shroud panel. In some examples, the interior has an oblong cross-section. In some examples, the apparatus includes a bracket coupled to the shroud at the first end or the second end, the bracket defining a bracket aperture through which the biasing member extends to couple the biasing member to the shroud. In some examples, the biasing member is an elastic band.

In some examples, the biasing member is a first biasing member, further including a second biasing member in the interior of the shroud spaced from the first biasing member. In some examples, the first shroud panel includes a first center portion and a second center portion separated by a first transverse line of weakness, and the second shroud panel includes a third center portion and a fourth center portion separated by a second transverse line of weakness, wherein the shroud is foldable about first and second transverse lines of weakness so that a first face of the first center portion is adjacent a first face of the second center portion, a second face of the first center portion is adjacent the third center portion, and a second face of the second center portion is adjacent the fourth center portion. In some examples, the apparatus is a self-erecting display.

The examples self-erectable displayed disclosed herein may be deployed from a storage state to an erected or deployed state with little effort. For example, a user such as, for example, a shop clerk, can remove a folded display from an outer packaging or container and unfold the display along the lines of weakness disclosed above. The force imparted by the biasing member(s) on the internal supports, automatically forces the outer shroud panels to expand away from one of other as disclosed above. In other words, as the display is unfolded, the display simply pops open by itself. The deployment of the display is then complete and the display is ready for placement in a desired location and/or coupling to an optional base should additional stability be desired.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a shroud including:

a first shroud panel;

a second shroud panel opposite the first shroud panel;

a first end separating the first shroud panel and the second shroud panel, the first end comprising a first shroud line of weakness between the first and second shroud panels;

a second end separating the first shroud panel and the second shroud panel, the first shroud panel including a first flap and the second shroud panel including a second flap;

a bracket removably positioned through the first end, the bracket including an eyelet; and an elastic band including a first elastic band end having a first end piece and a second elastic band end having a second end piece, the elastic band removably extending through the eyelet to couple the elastic band to the first end, the elastic band removably extending through the first flap to position the first elastic band end immediately adjacent thereto, the elastic band removably extending through the second flap to position the second elastic band end immediately adjacent thereto, the elastic band removably coupled to the shroud between the first and second ends to outwardly bias the first shroud panel relative to the second shroud panel to enable the shroud to have an oblong cross-section when erected.

2. The apparatus of claim 1, further including a first aperture defined along the first shroud line of weakness.

3. The apparatus of claim 2, wherein the bracket is to be disposed within the first aperture.

4. The apparatus of claim 1, wherein the shroud further includes a first side edge and a second side edge, the first side edge coupled to the second side edge at the second end.

5. The apparatus of claim 1, wherein the shroud is collapsible by urging the first shroud panel toward the second shroud panel against a biasing force of the elastic band to increase the distance between the first shroud line of weakness at the first end and the second end.

6. The apparatus of claim 5, wherein the first shroud panel includes a first transverse line of weakness and the second shroud panel includes a second transverse line of weakness, the first and second transverse lines of weakness to be immediately adjacent one another when the shroud is collapsed.

7. The apparatus of claim 6, wherein the shroud is foldable about the first and second transverse lines of weakness.

8. The apparatus of claim 1, wherein the second flap is coupled to the first flap.

9. The apparatus of claim 8, further including:

a first aperture formed in the first flap; and a second aperture formed in the second flap, the first aperture to align with the second aperture, and the elastic band coupled to the first aperture and the second aperture.

10. The apparatus of claim 9, wherein the first end piece includes a barb having a length greater than a first diameter of the first aperture and a second diameter of the second aperture.

11. The apparatus of claim 1, wherein the apparatus is a self-erecting display.

* * * * *